US005902256A

United States Patent [19]

Benaron

[11] Patent Number: 5,902,256

[45] Date of Patent: May 11, 1999

[54] MASSAGE UNIT WITH REPLACEABLE HOT AND COLD PACKS

[75] Inventor: Teri Benaron, Los Angeles, Calif.

[73] Assignee: JB Research, Inc., Bellflower, Calif.

[21] Appl. No.: 08/336,323

[22] Filed: Nov. 8, 1994

Related U.S. Application Data

[63] Continuation of application No. 08/017,614, Feb. 12, 1993, abandoned.

[51] Int. Cl.[6] ..... A61H 23/00

[52] U.S. Cl. ..... 601/15; 601/60; 601/64; 601/70; 601/71; 601/108; 601/112

[58] Field of Search ..... 601/15, 46, 57, 601/58, 60, 64, 67, 69, 70, 71, 79, 148; 600/15; 607/108, 96, 109, 111, 112

[56] References Cited

U.S. PATENT DOCUMENTS

| | | | |
|---|---|---|---|
| D. 290,654 | 6/1987 | Ohnishi | 128/32 |
| 1,927,751 | 9/1933 | Mensi | 128/403 |
| 2,792,829 | 5/1957 | Calosi . | |
| 2,920,617 | 1/1960 | Boiarsky . | |
| 3,062,203 | 11/1962 | Ziff | 128/36 |
| 3,356,086 | 12/1967 | Behney . | |
| 3,710,784 | 1/1973 | Taylor | 128/32 |
| 3,826,250 | 7/1974 | Adams | 601/16 |
| 4,125,112 | 11/1978 | Weihs | 601/46 |
| 4,377,160 | 3/1983 | Romaine | 602/2 |
| 4,513,736 | 4/1985 | Thurber | 601/15 |
| 4,592,358 | 6/1986 | Westplate | 128/402 |
| 4,607,624 | 8/1986 | Jefferson . | |
| 4,979,502 | 12/1990 | Hunt | 128/24.1 |
| 5,018,521 | 5/1991 | Campbell | 607/77 |
| 5,088,549 | 2/1992 | Schneider | 128/402 |
| 5,097,822 | 3/1992 | Francis et al. | 128/52 |
| 5,300,105 | 4/1994 | Owens | 607/114 |

FOREIGN PATENT DOCUMENTS

| | | | |
|---|---|---|---|
| 2090746 | 7/1982 | United Kingdom | 601/71 |

*Primary Examiner*—Jeanne M. Clark
*Attorney, Agent, or Firm*—Sheldon & Mak

[57] ABSTRACT

A hot and cold massaging unit (10) comprises a housing (12) having a receptacle (26) therein. A plurality of vibrators (36) are surrounded by padding (34) in the housing. A plurality of gel packs (32) which are capable of retaining heat and cold, are insertable within receptacle (26) which is then closable by a zipper (28). Gel packs (32) can therefor also be removed from and replaced in the receptacle.

15 Claims, 1 Drawing Sheet

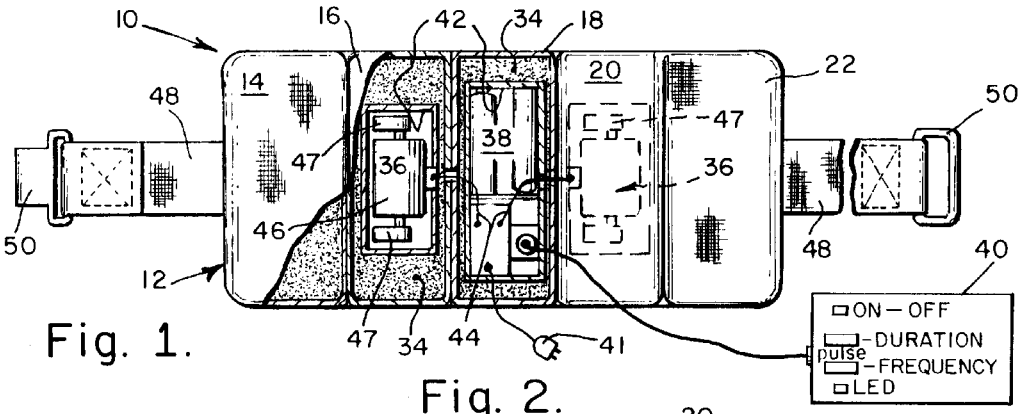
Fig. 1.
Fig. 2.
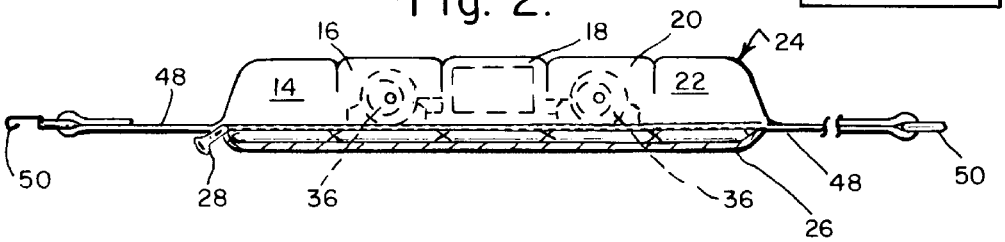
Fig. 3.
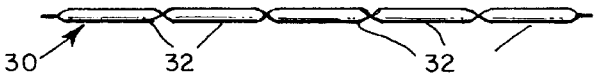
Fig. 4.
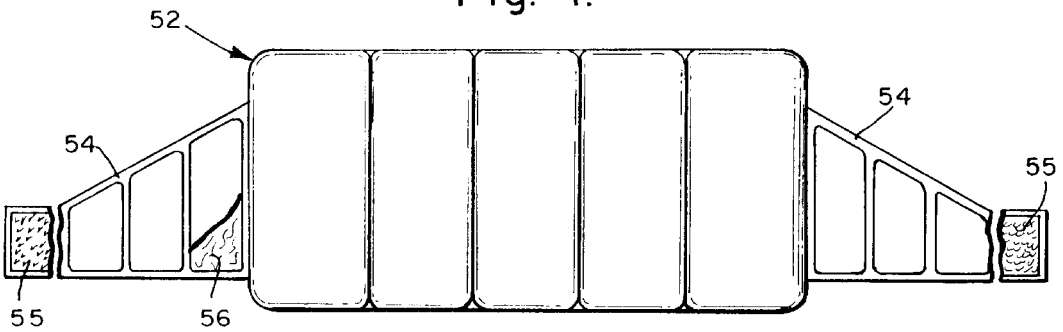
Fig. 5.
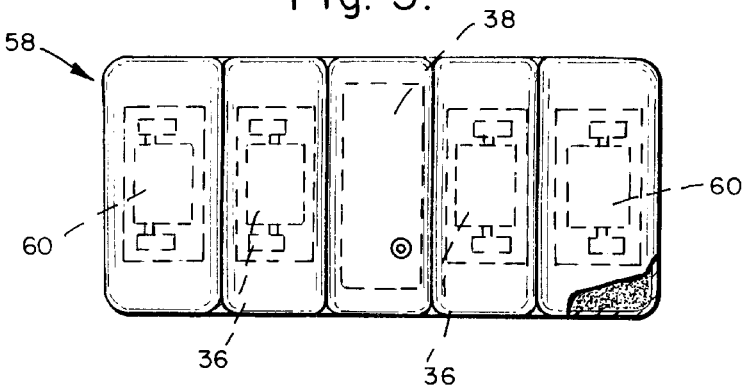

MASSAGE UNIT WITH REPLACEABLE HOT AND COLD PACKS

This is a continuation of application Ser. No. 08/017,614 filed Feb. 12, 1993 now abandoned.

BACKGROUND OF THE INVENTION

1. Field of the Invention

The present invention relates to a massage unit and, in particular, to such a unit which is disposed to apply heat or cold to a user through the use of heatable and coolable packs which can be inserted and replaced in the unit.

2. Description of Related Art and Other Considerations

Devices for the therapeutic massage of portions of the body are well known, such as are evidenced in U.S. Pat. Nos. 2,792,829, 2,920,617, 3,356,086 and 4,607,624 by which mechanical vibrations, such as produced by ultrasonic or mechanical means, is applied to the user's body either through an aqueous medium or solid material. In the first three patents, the aqueous medium is used only to transfer ultrasonic vibrations to the body. U.S. Pat. No. 4,607,624 discloses the combination of an integral massaging and heating device to afford greater relief than the application of either a massaging or a heating treatment alone. While the application of heat is one method for treating the body, it is sometimes necessary that the treatment require the application of cold, rather than heat. Also, the sources of heating or cooling may not always be available by recourse to household current, such as is required in U.S. Pat. No. 4,607,624. In addition, the ailment or need to be addressed sometimes dictates the type of heat or cold to be applied, e.g., dry or wet.

It is therefore desirable that the combined massaging and temperature application be tailored to the treatment desired and to the availability of sources both for operating the massaging unit and for the heat or cold.

SUMMARY OF THE INVENTION

These and other problems are successfully addressed and overcome by the present invention. Briefly, a massaging unit capable of applying heat or cold to a body utilizes one or more vibrators coupled to a temperature storing enclosure. The enclosure, which preferably comprises a series of hot or cold packs, can be coupled and uncoupled from the vibrators so that both vibrations and temperature may be applied to the user's body.

Specifically, the vibrators include a motor with eccentrics placed adjacent sleeves for reception of gel packs which are capable of retaining heat and cold. The sleeves can be closed, such as by a zipper, for retaining the gel packs within the sleeves. Straps or belts are attached to the unit, and the unit is configurable for use with a particular portion of the user's body, for example, the neck, the back, the lower lumbar and the upper and lower legs. Where appropriate, further gel packs are included within the straps.

Several advantages are derived from this arrangement. The use of replaceable heating or cooling packs permits full adaptation of heating and cooling in combination with massage. The replacement or exchange of heating and cooling sources permits them to be selected and tailored to the particular heating or cooling necessary, for example, wet and dry. The combined units may be powered by dry cell batteries to make them fully portable, but can be adapted for operation by household current or an automobile battery. The combination is simple in construction and, therefore, low in cost yet strong in construction.

Other aims and advantages, as well as a more complete understanding of the present invention, will appear from the following explanation of exemplary embodiments and the accompanying drawings thereof.

BRIEF DESCRIPTION OF THE DRAWINGS

FIG. 1 is top view, partially in section, of a first embodiment of the present invention suitable for placement adjacent the lumbar region of a user's body;

FIG. 2 is a side view of the embodiment depicted in FIG. 1, showing receptacles or pockets for receiving one or more hot or cold packs;

FIG. 3 is a side view of an assembly of hot or cold packs disposed for reception in the pockets shown in FIG. 2;

FIG. 4 illustrates another embodiment of the present invention suitable for placement about the neck of a user; and FIG. 5 is a top view of a third embodiment of the present invention showing the use of multiple vibrators.

DETAILED DESCRIPTION OF THE PREFERRED EMBODIMENTS

As shown in FIGS. 1–3, a hot and cold vibration massage unit 10 comprises a housing 12 including, for example as shown in FIG. 2, five sections 14, 16, 18, 20 and 22. Each section includes an upper portion 24 and a lower portion or receptacle 26. Lower portion 26 forms a fully enclosed receptacle which is openable at one side, but is closeable by means of a zipper 28.

A temperature storing enclosure 30, as shown in FIG. 3, is formed from a series of connected packs 32, which are constructed of matter which is capable of being heated or cooled and of retaining the heat and cold for application to a user's body. The preferred matter comprises a gel of conventional formulation; however, other constructions may be utilized, such as beads. Temperature storing enclosure 30 is configured so that it can be easily slipped into receptacle 26 and retained therein when zipper 28 closes the receptacle.

Upper portions 24 are adapted to contain padding 34, vibrators 36, a power supply 38, and controls 40. Padding 34 may comprise a foamed plastic composition. While the particular placements of these several elements are optional, in the embodiment disclosed in FIGS. 1 and 2, end sections 14 and 22 fully comprise padding 34, while middle sections 16, 18 and 20 have spaces 42 surrounded by the padding. A pair of vibrator assemblies 36 are positioned within spaces 42 of sections 16 and 20, while power supply 38 and controls 40 are positioned within space 42 of middle section 18. Electrical wires 44 couple the power supply to vibrators 36.

As shown, power supply 38 comprises one or more alkaline or other dry cell batteries, the number thereof being appropriately selected to power vibrators 36.

Each vibrator 36 includes an electric motor 46 and a pair of eccentrics 47 attached to the rotor shaft of the motor 46. Vibrators 36 are of conventional construction.

Controls 40 allow the user to turn the power on and off and to vary the frequency and intensity of the pulses. An indicator, such as an LED or LCD indicator, may be included as a power pulse display. The control for the duration or intensity of the Pulse may be formed as a slider switch. A potentiometer may be used as the control for the frequency of the pulse. All these controls are of conventional construction.

In addition, power supply 38 may be replaced by an electric cord 41 which can be coupled to conventional house current or to an automobile battery through suitable transformer apparatus.

Straps 48 with appropriate attachment means 50 are formed as part of housing 12 and are used to secure massaging unit 10 to the user's body.

The materials utilized for massaging unit 10 may comprise any suitable materials. Preferably, the material for housing 12 comprises a soft brushed nylon. Straps are of nylon webbing. Receptacle 26 is provided with a liner, such as of vinyl coated nylon, to protect motors 46 and power supply 38 from being short circuited by moisture which may result from condensation from the cold gel packs or from perspiration from the user's body.

FIG. 4 illustrates a massaging unit 52 which is constructed similarly as that of FIGS. 1 and 2, but has straps 54 and attachments 55 which are configured to permit attachment of unit 52 to the neck of the user. In addition, straps 54 have receptacles or sleeves therein, such as receptacles 26 of FIGS. 1 and 2, which are configured to receive one or more gel packs 56 therein.

As illustrated in FIG. 5, a massaging unit 58 is similarly constructed as shown in FIGS. 1, 2 and 4, except that additional vibrators 60 are added to existing vibrators 36. A power supply 38 is coupled to the several vibrators, and similar controls are included when controlling the frequency, intensity and power.

Although the invention has been described with respect to particular embodiments thereof, it should be realized that various changes and modifications may be made therein without departing from the spirit and scope of the invention.

What is claimed is:

1. A hot and cold massaging unit comprising:

a flexible housing which has a generally flat shape that is conformable to a user's body and which includes at least one receptacle therein of similar flat shape;

vibrator means contained within said housing adjacent said receptacle; and a self-contained temperature storage enclosure (1) which includes a material having the property of providing or releasing heat, (2) which has a flat shape similar to that of said receptacle so that said temperature storage enclosure can be easily inserted into and easily removed from said receptacle and (3) which is adapted both to transmit vibrations from said vibrator means and to apply its temperature to the user's body.

2. A unit according to claim 1 in which said material in said temperature storage enclosure includes a gel capable of retaining heat and cold.

3. A unit according to claim 1 further including closure means for said receptacle for ensuring retention of said enclosure within said receptacle.

4. A unit according to claim 3 in which said closure means comprises a zipper.

5. A unit according to claim 1 in which said receptacle includes a plurality of compartments and said enclosure includes a series of packs which are disposed for respective insertion in and removal from said compartments.

6. A unit according to claim 5 in which said compartments are serially communicable with one another and said packs are serially coupled together.

7. A unit according to claim 6 in which said temperature storage enclosure includes a gel capable of retaining heat and cold.

8. A unit according to claim 6 further including a closure for said receptacle for ensuring retention of said enclosure within said receptacle.

9. A unit according to claim 8 in which said closure means comprises a zipper.

10. A unit according to claim 5 in which said housing comprises:

a plurality of sections individually enclosing padding respectively positioned adjacent to said receptacle compartments; and portions defining spaces surrounded by and disposed in at least some of said sections for receiving said vibrator means.

11. A unit according to claim 10 in which said vibrator means comprises electric motor means with eccentrics driven thereby and a power supply therefor, said motor means and said power supply being retained within said portions.

12. A unit according to claim 11 further comprising attachment means for securing said housing to the user's body.

13. A unit according to claim 12 in which said temperature storage enclosure packs each includes a gel capable of retaining heat and cold, and further including additional temperature storage enclosure gel packs retained in said attachment means.

14. A unit according to claim 12 in which said housing and said attachment means are adapted to be shaped in configuration with that portion of the user's body to which said housing is to be secured.

15. A unit according to claim 11 further comprising speed and intensity controls and a power switch positioned adjacent to and in electrical connection with said power supply in one of said space portions within said padding.

* * * * *